US005916135A

United States Patent [19]

Yoshida et al.

[11] Patent Number: 5,916,135

[45] Date of Patent: Jun. 29, 1999

[54] ENGINE EXHAUST EMISSION CONTROL SYSTEM IN OUTBOARD ENGINE SYSTEM

[75] Inventors: Hiroyuki Yoshida; Motoyoshi Shishido; Toyokazu Kawasaki, all of Wako, Japan

[73] Assignee: Honda Giken Kogyo Kabushiki Kaisha, Tokyo, Japan

[21] Appl. No.: 08/763,940

[22] Filed: Dec. 12, 1996

[30] Foreign Application Priority Data

Dec. 12, 1995 [JP] Japan ..... 7-322603

[51] Int. Cl.[6] ..... F01N 3/10

[52] U.S. Cl. ..... 60/302; 440/89

[58] Field of Search ..... 60/302, 310; 440/89

[56] References Cited

U.S. PATENT DOCUMENTS 5,100,351 3/1992 Shibata .
5,118,316 6/1992 Kakizaki et al. .
5,439,651 8/1995 Kato ..... 422/179
5,546,748 8/1996 Iwai et al. ..... 60/302
5,553,586 9/1996 Koishikawa ..... 60/302
5,554,060 9/1996 Koishikawa ..... 60/302

*Primary Examiner*—Thomas E. Denion
*Attorney, Agent, or Firm*—Nikaido, Marmelstein, Murray & Oram LLP

[57] ABSTRACT

An exhaust gas emission control system for a 4-cycle outboard engine is disclosed. The engine comprises a mounting member; an engine block mounted on the mounting member; an extension housing coupled to the mounting member and extending downward therefrom; and an engine oil pan mounted under the mounting member within the extension housing. The oil pan has a recess formed therein in the lengthwise direction. An exhaust gas expansion chamber is formed in the extension housing for receiving exhaust gas from the exhaust manifold of the engine. The engine exhaust emission control system comprises a catalyst assembly positioned in the exhaust gas expansion chamber, the catalyst assembly having a catalyst case aligned with the oil pan in the lengthwise direction thereof. At least a portion of the catalyst case is disposed in the recess in the oil pan.

11 Claims, 17 Drawing Sheets

ENGINE EXHAUST EMISSION CONTROL SYSTEM IN OUTBOARD ENGINE SYSTEM

BACKGROUND OF THE INVENTION

1. Field of the Invention

The present invention relates to an exhaust emission control system using a catalyst for 4-cycle engine in an outboard engine for a boat.

2. Description of the Prior Art

There is a conventionally known an exhaust emission control system in an outboard engine system, in which a catalytic converter is mounted in the exhaust system to purify the exhaust gas (for example, see Japanese Patent Application Laid-Open Nos. 3-23308 and 2-260893).

In general, a 2-cycle engine is mainly used as an engine for an outboard engine system for a boat because at is light in weight; it can be provided at a low cost, and it is easy to handle. However, a recent tendency is to replace the 2-cycle engine with a 4-cycle engine which is superior for countering exhaust emission, exhaust noise and the like.

However, the 4-cycle engine is large in bulk, as compared with the 2-cycle engine and in particular, includes an oil pan having a large volume. If a catalyst device is further mounted in an exhaust system of the 4-cycle engine, a problem is encountered in that the size of the outboard engine system itself, particularly, its upper portion, is further increased.

SUMMARY OF THE INVENTION

The present invention has been accomplished with such circumstance in view, and it is an object of the present invention to provide an engine exhaust emission control system in a novel outboard engine system, wherein the oil pan and the catalytic converter can be compactly contained together within an extension housing in the housing body of the outboard engine system, thereby solving the above problem and further possibly enhancing the exhaust gas purifying capability of the catalyst.

To achieve the above object, according to the present invention, there is provided an engine exhaust emission control system in an outboard engine system which comprises an engine block of a 4-cycle engine mounted on a mounting member; an oil pan of the engine supported in a suspended manner under the mounting member; the oil pan being contained in an extension housing which is integrally provided on the mounting member to extend downward therefrom; and an exhaust gas expansion chamber formed within the extension housing for guiding the exhaust gas from the engine block. The engine emission control system comprises a catalyst assembly contained in the exhaust gas expansion chamber, having a catalyst therein, the catalyst assembly guiding the exhaust gas discharged from the engine block. The catalyst assembly has a catalyst case which is formed flat in cross section, the lengthwise direction of the cross section being in a lengthwise direction of a cross section of the oil pan, the catalyst case being disposed in line with the oil pan, wherein at least a portion of the catalyst case is contained in a recess formed in the oil pan.

In addition, the oil pan includes a drain portion which opens to the side of the extension housing, the oil pan and the catalyst assembly being aligned in a lateral direction with respect to a longitudinal direction of the extension case on the opposite side from the drain portion.

Further, the catalyst assembly includes an exhaust introduction pipe communicating with an exhaust manifold of the 4-cycle engine E, and an exhaust gas discharging pipe which opens into the exhaust gas expansion chamber. The exhaust introduction pipe and the exhaust gas discharging pipe are aligned in the lengthwise direction of the cross section of the catalyst case which is flat in cross section in that it has flat sides in the lengthwise direction. An exhaust gas purifying passage is formed within the catalyst case by the exhaust introduction pipe and the exhaust gas discharging pipe, the catalyst being disposed in the exhaust gas purifying passage for purifying an exhaust gas flowing in the exhaust gas purifying passage.

Still further, the catalyst assembly comprises a catalyst case flat in cross section; a partition wall for partitioning the interior of the catalyst case into a first chamber and a second chamber; an exhaust gas introduction pipe inserted into the catalyst case through the top wall thereof to permit communication between the exhaust manifold and the first chamber; and an exhaust gas discharging pipe inserted into the catalyst case through the bottom wall thereof to permit communication between the second chamber and the exhaust gas expansion chamber. An exhaust gas purifying passage is formed within the catalyst case, the catalyst being mounted in the exhaust gas purifying passage for purifying the exhaust gas flowing in the exhaust gas purifying passage, the exhaust gas discharging pipe having an inlet located above the catalyst.

DETAILED DESCRIPTION OF THE PREFERRED EMBODIMENTS

A first embodiment of the present invention will be described with reference to FIGS. 1 to 9.

Figure 1:
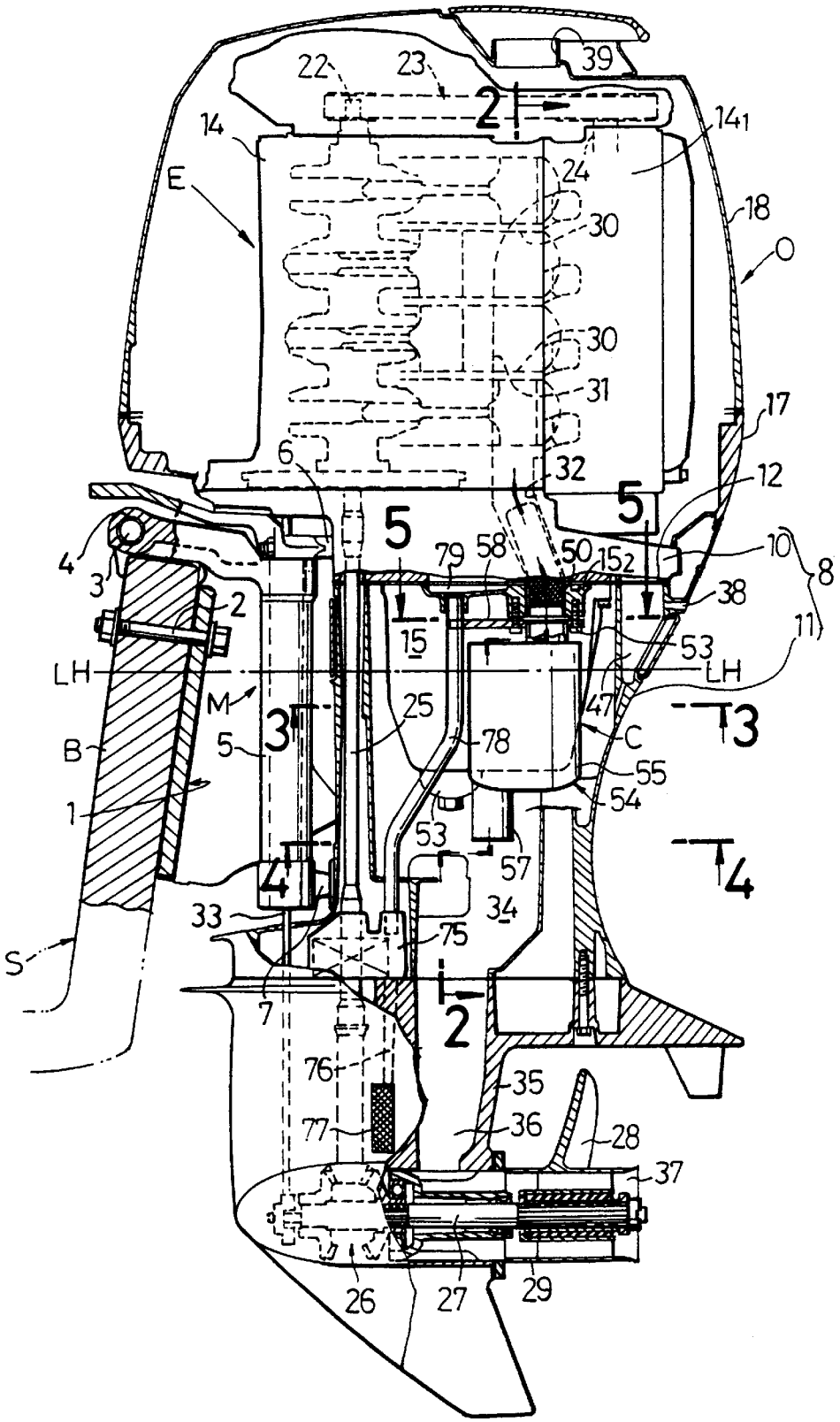
FIG. 1 is a vertical sectional side view of an outboard engine system equipped with a system according to the present invention.
Figure 2:
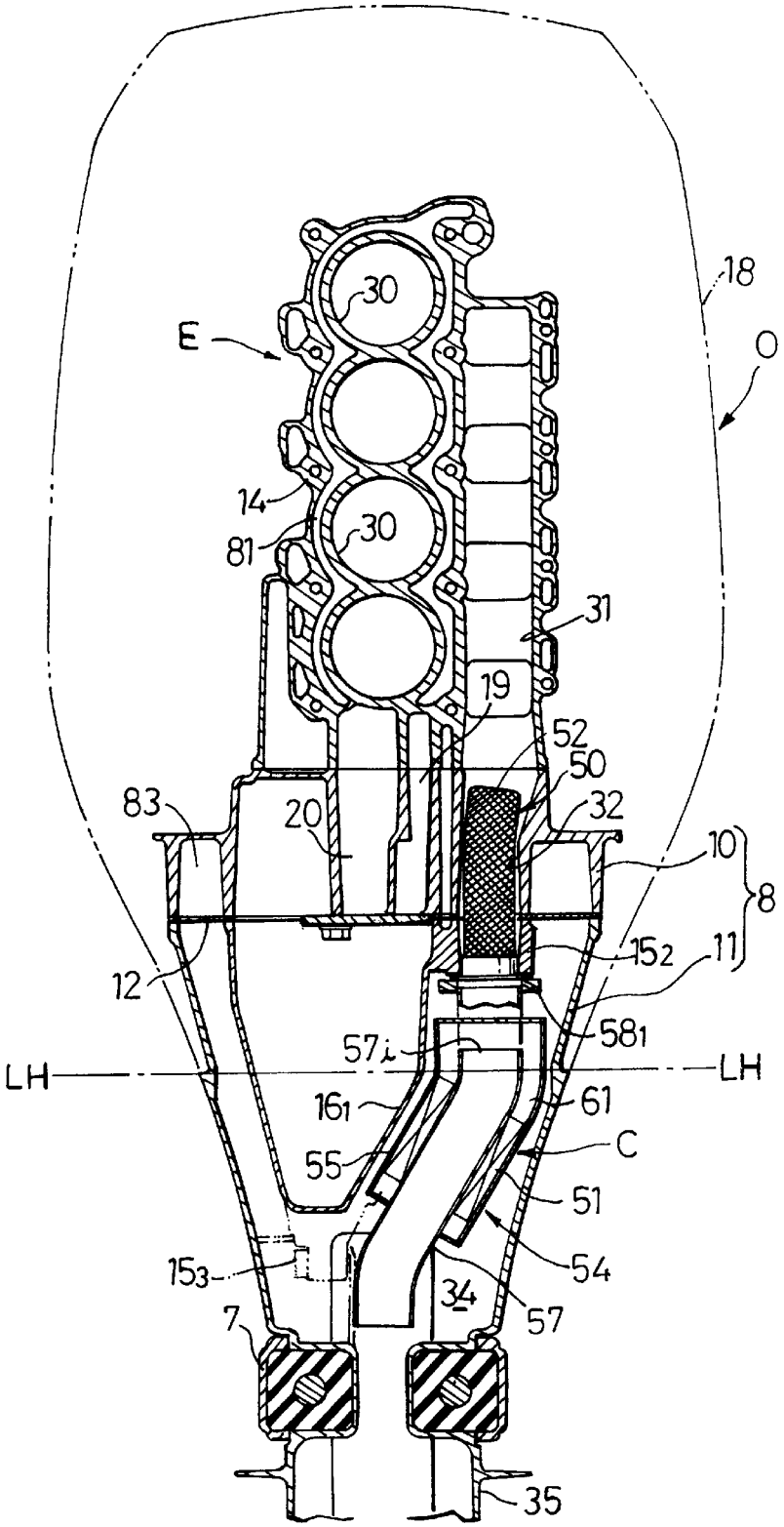
FIG. 2 is a partially vertical sectional view of the outboard engine system taken along a line 2—2 in FIG. 1.

Referring to FIGS. 1 and 2, an outboard engine system O is detachably mounted to a stern B of a boat body S through a mounting device M. The mounting device M includes a stem bracket 1 detachably mounted to the stern plate B by a mounting bolt 2, and a swivel mount 4 which is pivotally mounted for vertical swinging movement to the stern bracket 1 through a tilting shaft 3 laterally positioned at the front end of the stern bracket 1. A vertically extending swivel shaft 5 is rotatably mounted on the swivel mount 4, and a housing 8 of the outboard engine system O is mounted on the swivel shaft 5 through an upper mount 6 and a lower mount 7. Thus, the outboard engine system O can be vertically swung about the tilting shaft 3 and laterally turned about a vertical axis of the swivel shaft 5.

The structure for mounting of the outboard engine system to the boat body S is a conventional, well known structure.

Figure 3:
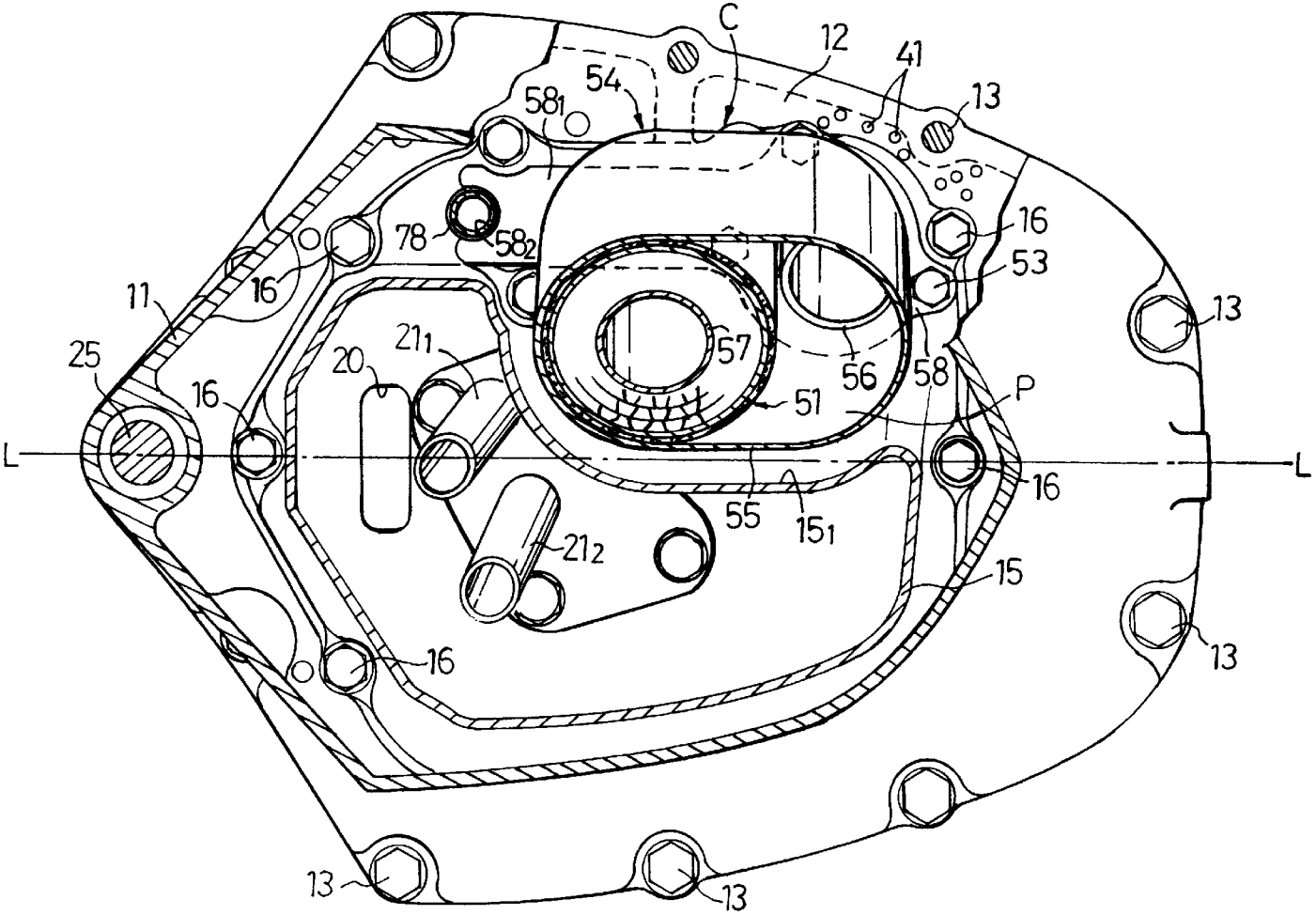
FIG. 3 is an enlarged cross-sectional bottom view of the outboard engine system taken along a line 3—3 in FIG. 1.
Figure 4:
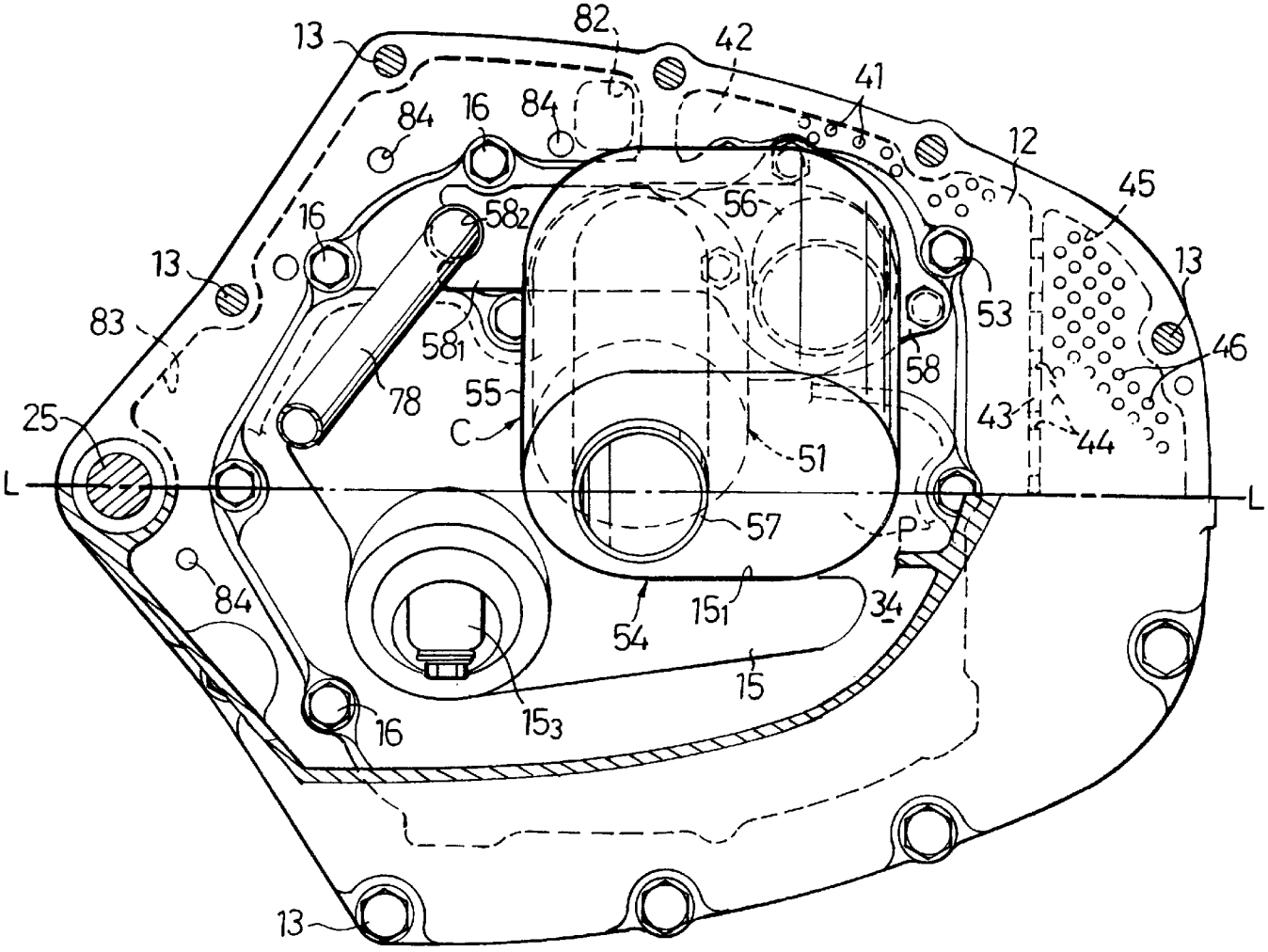
FIG. 4 is an enlarged cross-sectional bottom view of the outboard engine system taken along a line 4—4 in FIG. 1.

The housing 8 of the outboard engine system O includes a mounting member 10 having upper and lower mounting surfaces, and a hollow cylindrical extension housing 11 secured to the lower surface with a gasket 12 interposed therebetween by a plurality of bolts 13 (see FIGS. 3 and 4). An engine block 14 of a 4-cycle engine E, made by die-casting, is mounted on the mounting member 10 for driving the outboard engine system in a propelling manner. An oil pan 15 of the engine E is integrally supported in a suspended manner under the mounting member 10 by a plurality of bolts 16 (see FIG. 3 and 4).

The lower half of the 4-cycle engine E is covered with an under-case 17 connected to the extension housing 11, while the upper half of the engine E is covered with an engine cover 18 detachably coupled to an upper edge of the under-case 17 with a packing interposed therebetween. An air intake 39 is opened in an upper portion of the engine cover 18, so that breathing is performed inside and outside the engine cover 18 through the air intake 39.

The engine E is a water-cooled, 4-cylinder, vertical 4-cycle type engine, and has a crankshaft 22 which extends vertically in the engine block 14. A cam shaft 24 for driving a valve-operating mechanism of the engine through a belt-type timing and transmitting mechanism 23 is operatively connected to an upper end of the crankshaft 22, and a vertical shaft 25 is connected at its upper end, to a lower end of the crankshaft 22 and extends longitudinally within the housing 8. The vertical shaft 25 is connected at its lower end through a forward and backward movement switching mechanism 26, to a propeller shaft 27 which is connected to a propeller 28. Thus, an output from the engine E is transmitted through the crankshaft 22, the vertical shaft 25, the forward and backward movement switching mechanism 26 and the propeller shaft 27 to the propeller 28. On the drawings 33 is a shifting rod for switching the direction of rotation of the propeller shaft 27.

The oil pan 15 suspendedly supported on the lower surface of the mounting member 10, is formed into a bucket-like shape with a relatively large volume to store oil for lubricating the 4-cycle engine E therein, and is positioned within the extension housing 11. Thus, the oil in the oil pan 15 is supplied through an oil suction pipe 21 and an oil suction passage 19 (see FIG. 2) to oil supply portions such as a crank chamber, a cam chamber and the like in the engine block 14 by an oil pump which is not shown, and the oil from the engine block 14 is returned through an oil return passage 20 and an oil return pipe $\mathbf{21}_2$ (see FIG. 3) to the oil pan 15.

A recess 15, is vertically and longitudinally formed near a central portion of a side wall of the extension housing 11, to receive a catalyst case 55 of a catalyst assembly which will be described hereinafter. The recess $\mathbf{15}_1$ is gradually, inwardly deeper and deeper from an upper portion to a lower portion of the oil pan 15, as shown in FIGS. 3 and 4. A drain $\mathbf{15}_3$ is provided sideways in the lower portion of the oil pan 15 and opens laterally toward a side of the extension housing 11. This drain $\mathbf{15}_3$ is provided on the opposite side of the oil pan 15 from the position of a catalyst assembly 54 which will be described hereinafter, with respect to a center line L—L extending longitudinally in the outboard engine system O, so that mutual interference can be avoided.

An exhaust system including primary and secondary catalysts 50 and 51 in the 4-cycle engine E will be described below. An exhaust manifold 31, at which exhaust ports of four cylinders 30 join together, is formed vertically along the direction of arrangement of the cylinders 30 in a cylinder head $\mathbf{14}_1$, of the engine block 14. An opened lower end of the exhaust manifold 31 is in communication with an exhaust passage 32 which is defined in the mounting member 10 and an extension $\mathbf{15}_2$ of a mounting flange of the oil pan 15. A lower end of the exhaust passage 32 opens into the extension housing 11, and an inlet of the catalyst assembly C which will be described hereinafter and which is accommodated in the extension housing 11, is in communication with the lower end of the exhaust passage 32. An outlet of the catalyst assembly C opens into an exhaust gas expansion chamber 34 defined in a lower portion of the extension housing 11. The exhaust gas expansion chamber 34 is also in communication with the outside through a main exhaust gas passage 36 defined in a gear case 35 connected to a lower surface of the extension case and through a main exhaust gas outlet 37 defined within a propeller boss 29 integral with the propeller 28. The inside of the exhaust gas expansion chamber 34 is also in communication with a subsidiary exhaust gas outlet 38 which opens into an upper portion of a back surface of the extension housing 11. More specifically, as shown in FIG. 4, the exhaust gas expansion chamber 34 is in communication with a first subsidiary exhaust gas passage 42 defined in a lower surface of the mounting member 10 through a large number of first small bores 41 which open through the gasket 12. Further, the first subsidiary exhaust gas passage 42 is in communication with a second subsidiary exhaust passage 45 defined in the lower surface of the mounting member 10 through a through-hole 44 made in a partition wall 43. The second subsidiary exhaust passage 45 is also in communication with the subsidiary exhaust gas outlet 38 through a large number of second small bores 46 which open through the gasket 12 and through a subsidiary exhaust gas chamber 47 (see FIG. 1).

An exhaust gas generated by the operation of the 4-cycle engine E flows from the exhaust manifold 31 through the exhaust passage 32 into the catalyst assembly C (which will be described hereinafter) having the first and second catalysts 50 and 51 incorporated therein, where harmful components such as $NO_x$, CO, HC and the like are oxidized and reduced. Thereafter, the purified exhaust gas flows into the exhaust gas expansion chamber 34, and a portion of the exhaust gas in the exhaust gas expansion chamber 34 is passed through the main exhaust gas passage 36 and the main exhaust gas outlet 37 and released to the outside. Further, the remaining exhaust gas is passed through the first small bores 41, the first subsidiary exhaust gas passage 42, the through-hole 4, the second subsidiary exhaust gas passage 45, the second small bores 46 and the subsidiary exhaust gas chamber 47 and released to the outside.

The specific structure of the catalyst assembly C will be described below with reference to FIGS. 5 to 9 in addition to FIGS. 1 to 4.

The catalyst assembly C includes a vertical-type primary catalyst 50 and a secondary catalyst 51. The primary and secondary catalysts 50 and 51 may be of different types or the same type. For example, the so-called vertical-type primary catalyst 50 may be a platinum catalyst serving as an auxiliary catalyst for reducing harmful components mainly such as $NO_x$ and the like. Alternatively, the primary and secondary catalysts 50 and 51 may be ternary catalysts, so that secondary air can be introduced immediately in front of the downstream secondary catalyst 51 to oxidize harmful components such as HC, CO and the like.

The primary and secondary catalysts 50 and 51 may be of any type employed depending upon the degree of purification of the exhaust gas.

The primary catalyst 50 comprises a plurality of catalyst carriers which have a catalyst element carried therein and which is accommodated in a flexible porous catalyst cover 52 formed of a heat-resistant mesh of a metal or the like into an elongated bag-like configuration, so that the catalyst 50 can be freely flexed. The primary catalyst 50 is inserted into the exhaust passage 32 from the lower surface of the mounting member 10 and fixed, along with a catalyst assembly 54 (which will be described hereinafter) of the secondary catalyst 51, to the extension $\mathbf{15}_2$ of the mounting flange of the oil pan 15 by a plurality of bolts 53.

The primary catalyst 50 and the catalyst assembly 54 of the secondary catalyst 51 may be directly attached to the lower surface of the mounting member 10.

Since the primary catalyst 50 is inserted into the exhaust passage 32 in the vicinity of the exhaust manifold 31, a high-temperature exhaust gas is passed through the primary catalyst 53, but the primary catalyst 50 is mainly effective for removing $NO_x$ in the exhaust gas, prior to an oxidizing reaction (a high temperature is basically convenient in the oxidizing reaction of HC and CO) which will be described hereinafter. It is desirable that the primary catalyst 50 be supported so that it cannot be deformed by an exhaust gas pressure. Alternatively, the primary catalyst 50 may be formed long enough to reach the exhaust manifold 31.

The catalyst assembly 54 of the secondary catalyst 51 has a closed catalyst case 55 which is formed into a substantially elliptic flat shape, in cross section, with a relatively large volume and comprises a top wall 55*t*, a bottom wall 55*b* and a side wall 55*w*, an exhaust gas introduction pipe 56 inserted into the catalyst case 55 through the top wall 55*t* at a location near one side, and an exhaust gas discharging pipe 57 inserted into the catalyst case 55 through the bottom wall 55*b* at a location near the other side. As shown in FIGS. 3 and 4, the catalyst assembly 54 is inclined inwardly from the top toward the bottom within the extension housing 11 and is juxtaposed in proximity to the oil pan 15, with at least a portion of the catalyst assembly 54 being received in the recess $\mathbf{15}_1$ defined in the side wall of the oil pan 15. On the whole, the catalyst assembly 54 and the oil pan 15 are compactly accommodated within the extension housing 11 without any partial protrusion.

Figure 7:
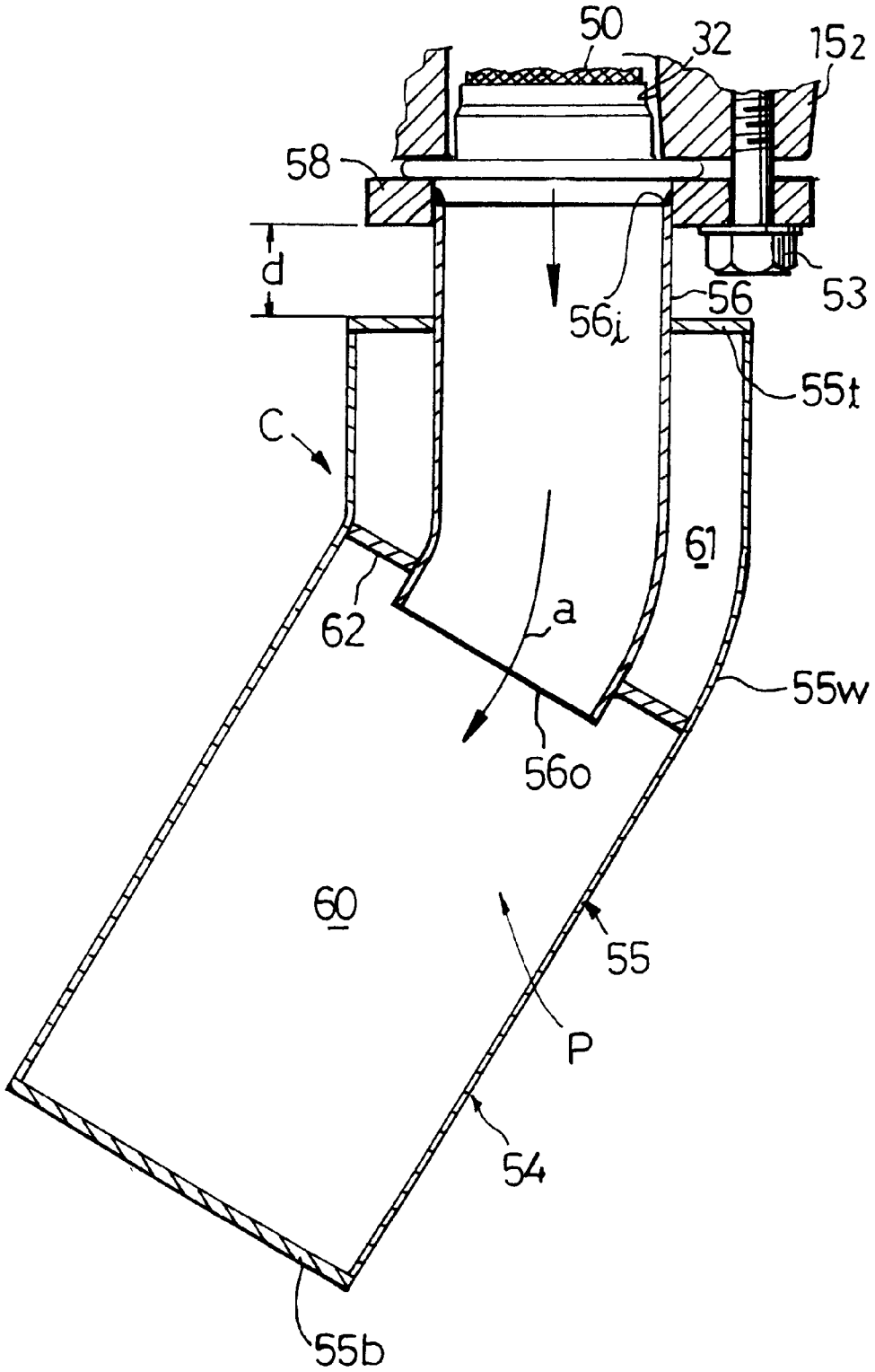
FIG. 7 is a vertical sectional view of the catalyst assembly taken along a line 7—7 in FIG. 5.

A mounting flange 58 is secured to an upper end 56*i* of the exhaust gas introduction pipe 56 and also secured along with the primary catalyst 50 to the lower surface of the extension $\mathbf{15}_2$ of the oil pan 15 by the plurality of bolts 53, as shown in FIG. 7. Thus, the catalyst assembly 54 is integrally supported in a suspended manner on the mounting member 10. A gap d of a predetermined width is defined between the mounting flange 58 and an upper surface of the catalyst case 55 to facilitate the mounting of the catalyst assembly 54.

Figure 8:
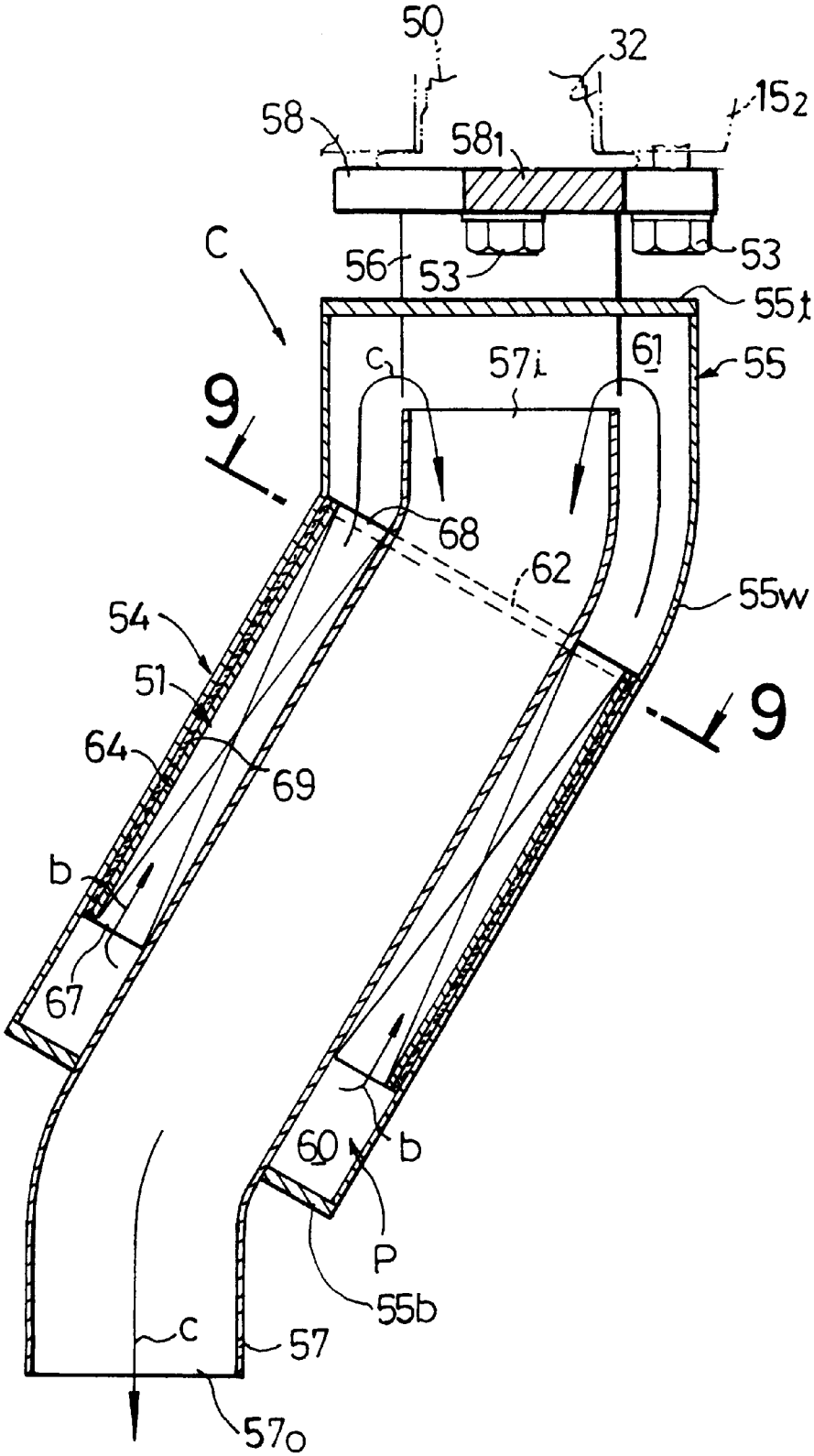
FIG. 8 is a vertical sectional view of the catalyst assembly taken along a line 8—8 in FIG. 5.

The exhaust gas introduction pipe 56 extends to the middle of the catalyst case 55 and is secured at its inner end to a partition wall 62 for partitioning the inside of the catalyst case 55 into a first chamber 60 and a second chamber 61, by welding or the like, as best shown in FIG. 7. An outlet 56*o* of the exhaust gas introduction pipe 56 communicates with the first chamber 60. As best shown in FIG. 8, the exhaust gas discharging pipe 57 is bent into an S-shape and extends longitudinally within the first chamber 60 and through the partition wall 62 to reach near the upper end of the catalyst case 55. The exhaust gas discharging pipe 57 has an inlet 57*i* which communicates with the second chamber 61, and an outlet 57*o* which is extended to the outside.

Figure 5:
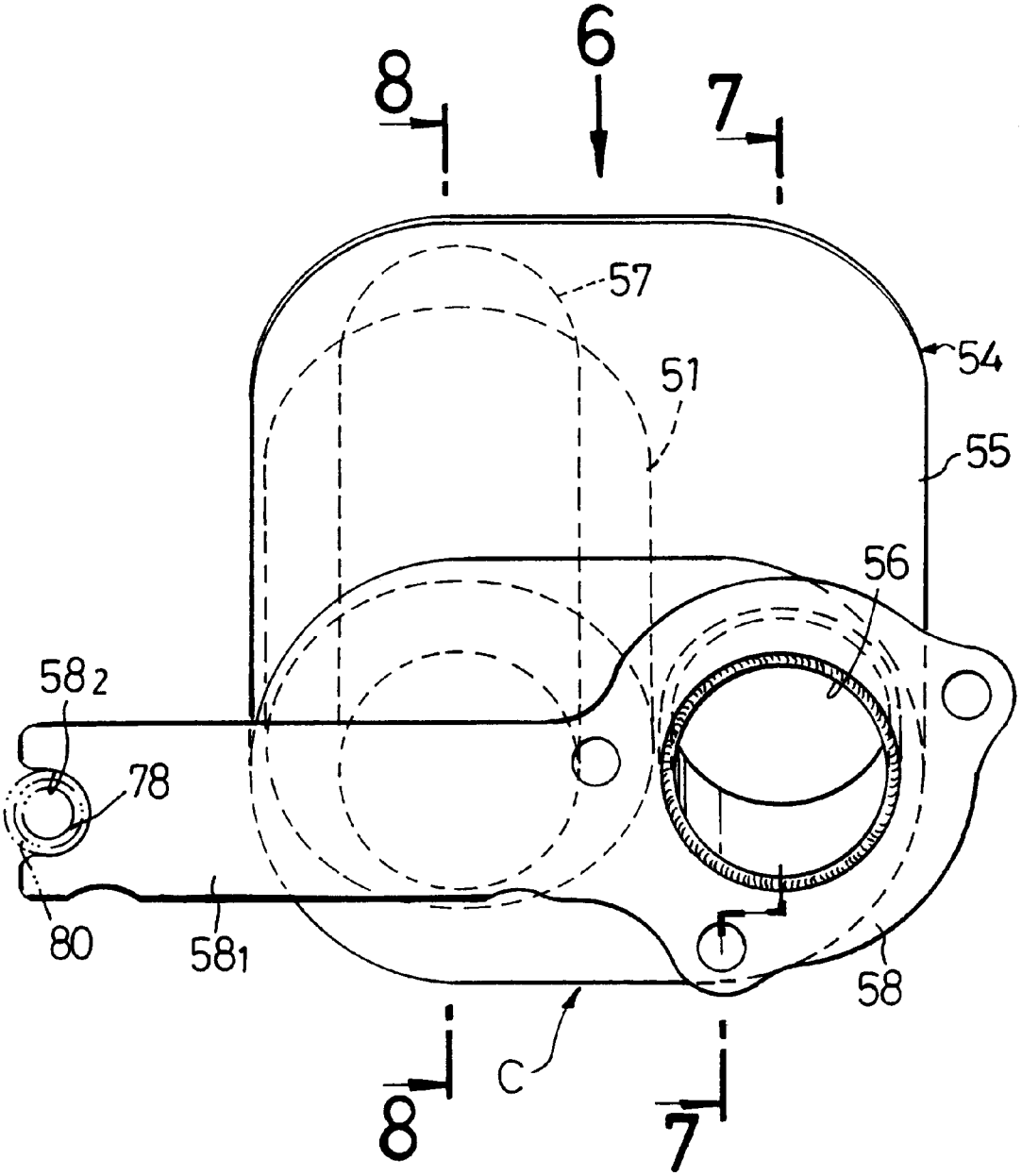
FIG. 5 is a plan view of a catalyst assembly taken along a line 5—5 in FIG. 1.
Figure 6:
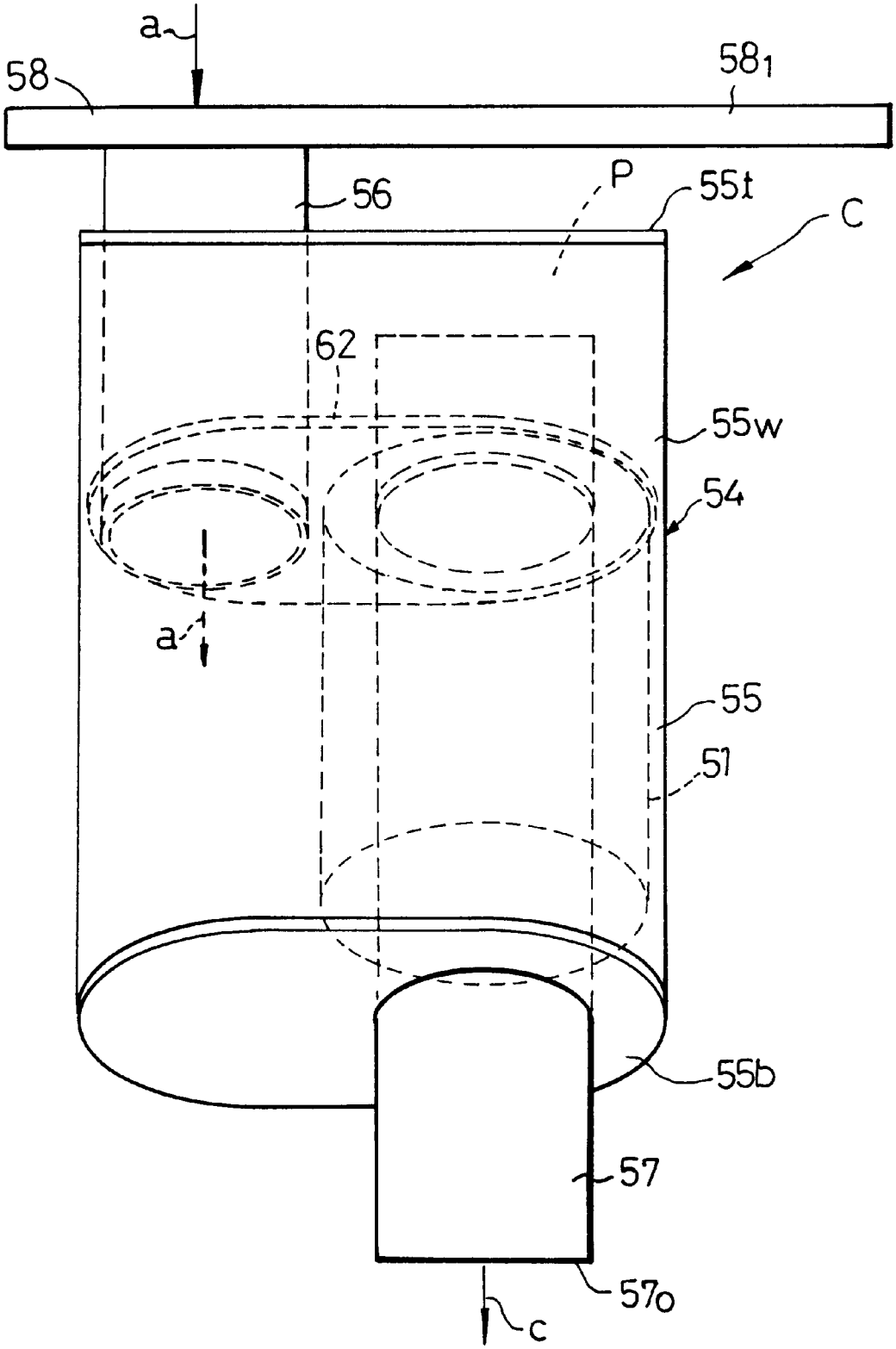
FIG. 6 is a side view of the catalyst assembly taken in a direction of an arrow 6 in FIG. 5.

As best shown in FIG. 5, an arm is integrally provided on the mounting flange 58 to extend therefrom sideways of the oil pan 15. A semi-circular engage portion $\mathbf{58}_2$ is formed at a free end of the arm $\mathbf{58}_1$ for engagement with a middle portion of a water discharge pipe 78 (which will be described hereinafter) in order to retain the water discharge pipe 78.

Figure 9A:
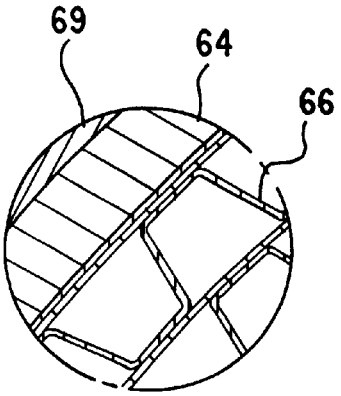
FIG. 9 is a vertical sectional view of the catalyst assembly taken along a line 9—9 in FIG. 8.
Figure 9:
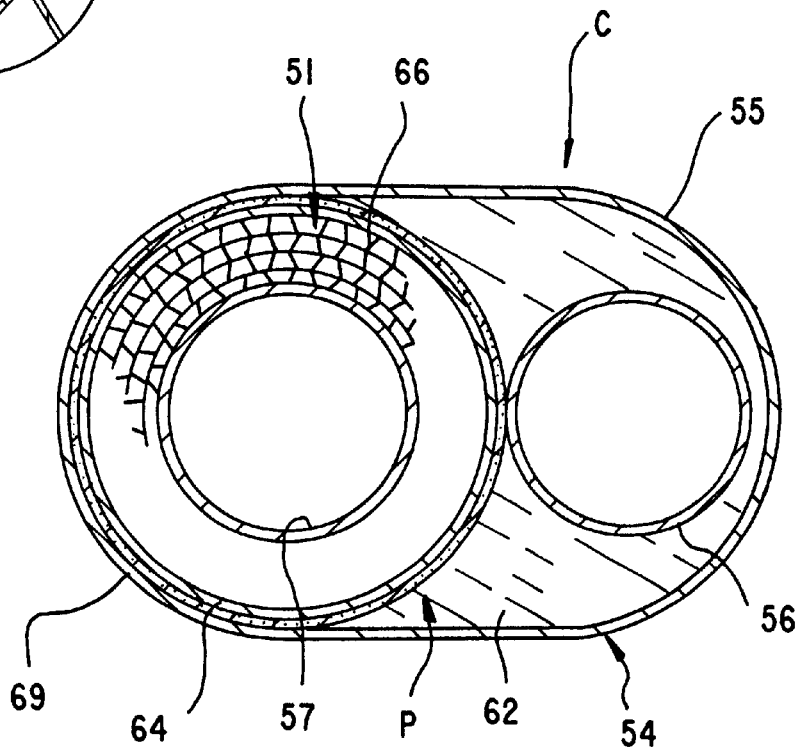
Figure 10:
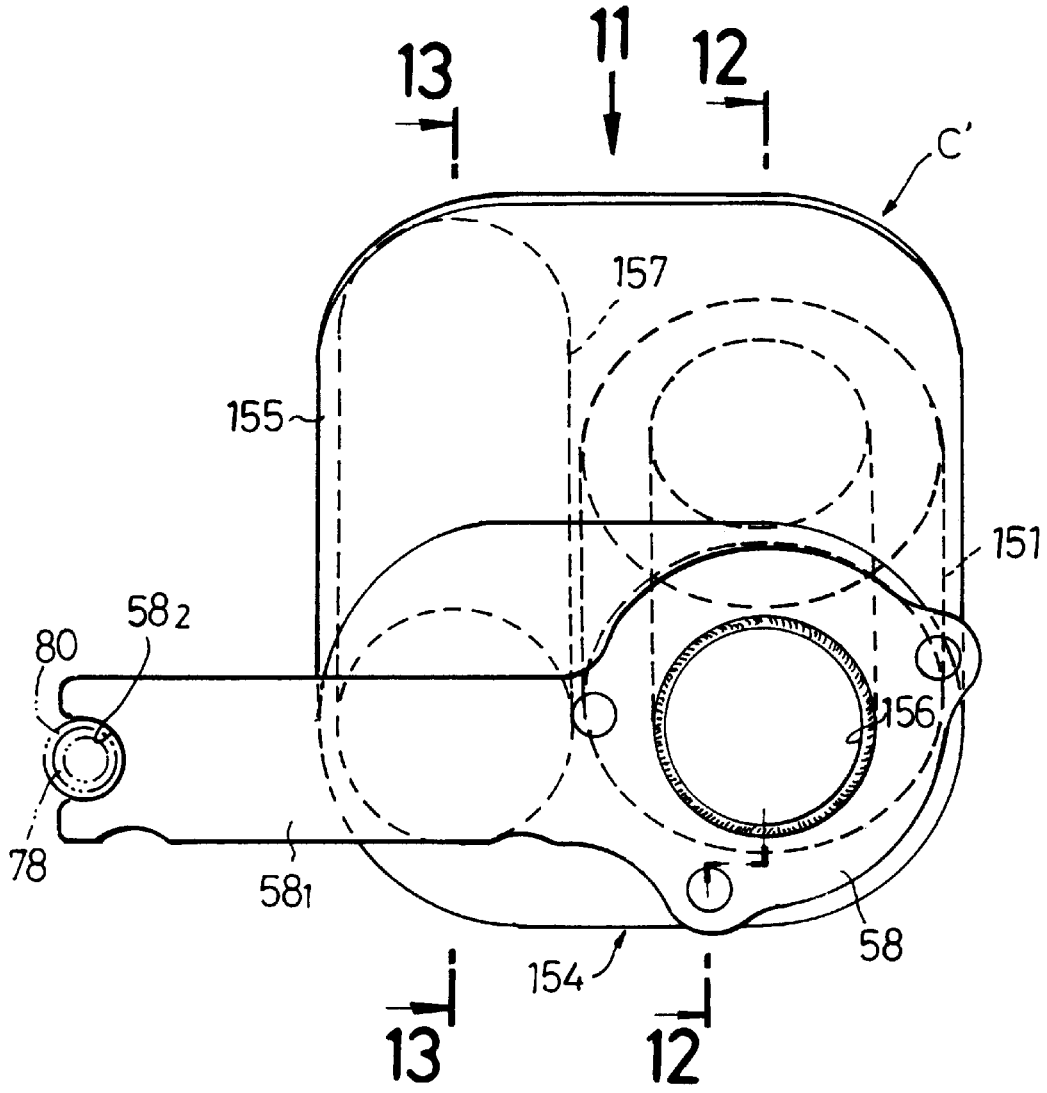
FIG. 10 is a plan view of a second embodiment of the catalyst assembly.
Figure 11:
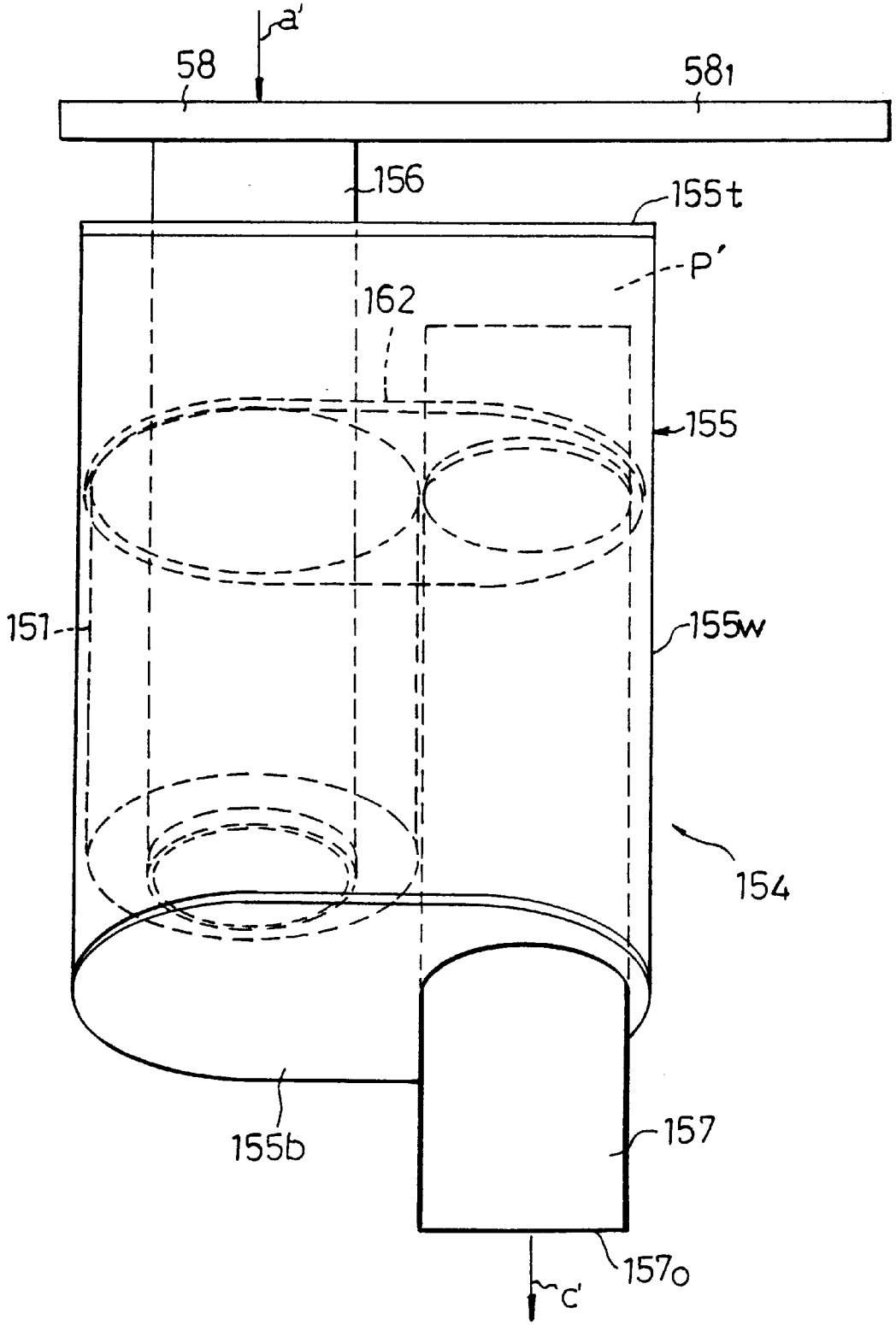
FIG. 11 is a side view of the catalyst assembly taken in a direction of an arrow 11 in FIG. 10.

The secondary catalyst 51 cylindrically formed, is secured to an outer periphery of the exhaust gas discharging pipe 57 within the first chamber 60 by brazing to be able to withstand a high-temperature condition. The secondary catalyst 51 is comprised of a cylindrical outer shell 64 and a catalyst carrier 66 of a honeycomb structure having a catalyst element interposed between the outer shell 64 and the exhaust gas discharging pipe 57, as shown in FIGS. 8 and 9. The secondary catalyst 51 has an inlet 67 provided at one end thereof and communicates with the first chamber 60, and an outlet 68 provided at the other end thereof passes through the partition wall 62 to communicate with the second chamber 61. A heat-insulating material 69 is wound around an outer periphery of the secondary catalyst 51, with outer half of the heat-insulating material 69 being closely bonded to an inner surface of the catalyst case 55.

Exhaust gas from the engine E passes through the exhaust manifold 31 and the exhaust passage 32 into the vertical-type primary catalyst 50, where the exhaust gas is primarily purified, and then, it passes into the secondary catalyst 51. Within the secondary catalyst 51, the exhaust gas flows downward from the exhaust introduction pipe 56 to enter the first chamber 60, as indicated by an arrow a in FIG. 7. The exhaust gas reverses its course in the first chamber 60, to flow upwardly into the secondary catalyst 51, as shown by an arrow b in FIG. 8, where it is secondarily purified. Thereafter, the gas flows into the second chamber 61, where it further reverses its course to flow downwards again into the exhaust gas introduction pipe 57, as shown by an arrow c in FIG. 8 and then flows into the exhaust gas expansion chamber 34 within the extension housing 1. In the above manner, the exhaust gas flows within an exhaust gas purifying passage P defined within the catalyst assembly case 54, while being expanded by the discharging from the exhaust gas introduction pipe 56 and constricted by flowing into the exhaust gas discharging pipe 57, wherein the expansion and constriction are repeated. For this period of time, the exhaust noise is effectively attenuated and at the same time, the exhaust gas is effectively purified by the secondary catalyst 51 maintained at a proper temperature by the heat of the exhaust gas. The immersion of secondary catalyst 51 into the water is reduced by the fact that the inlet 57*i* of the exhaust gas discharging pipe 57 is disposed above the secondary catalyst 51.

A water draft line LH—LH is shown in FIGS. 1 and 2, lies at an upper location when the outboard engine system is at rest.

Returning again to FIGS. 1 and 2, a water pump 75 is disposed near a front portion of the extension housing 11 and is driven by the vertical shaft 25. A water suction pipe 76 is connected to the suction port of the water pump 75 and extends downward into the gear case 35, and a strainer 77 is connected to a lower end of the water suction pipe 76. A water discharge pipe 78 is connected to the discharge port of the water pump 75 and extends upwards within the extension housing 11. An upper end of the water discharge pipe 78 communicates with a water supply passage 79 which as defined in the flange portion of the oil pan 15. Alternatively, the water supply passage 79 may be formed in the mounting member 10.

An upper portion of the water discharge pipe 78 is engaged with and retained on the engage portion $\mathbf{58}_2$ at the tip end of the arm $\mathbf{58}_1$ which is extended from the mounting flange 58, as described above. The water supply passage 79 communicates with an inlet of a water jacket 81 which is defined in the engine block 14 and whose outlet communicates with a water return passage 82 (see FIG. 4) extending through the mounting member 10. The water return passage 82 opens into a cooling-water passage 83 which is defined by the recess made in the lower surface of the mounting member 10 and the gasket 12, and a plurality of small water discharge bores 84 are made in the gasket 12 for permitting the cooling-water passage 83 to communicate with the outside of the oil pan within the extension housing 11.

When the water pump 75 is driven by the operation of the engine E, water stored in the gear case 35 is pumped through the strainer 77 and the suction pipe 76; pressurized by the water pump 75 and passed into the water jacket 81 in the engine block 14 to cool the engine block 14. After cooling of the engine block 14, the water is passed from the outlet of the water jacket 81 through the water return passage 82 into the cooling-water passage 83 and then through the plurality of small water discharge bores 84 to become a mist, which drops to the periphery of the oil pan 15 within the extension case to effectively cool the oil pan 15.

A second embodiment of the present invention will now be described with reference to FIGS. 10 to 13, wherein the same members or portions as those in the first embodiment are designated by like reference numbers.

The second embodiment is slightly different from the first embodiment with respect of the structure of a catalyst assembly C'.

Figure 12:
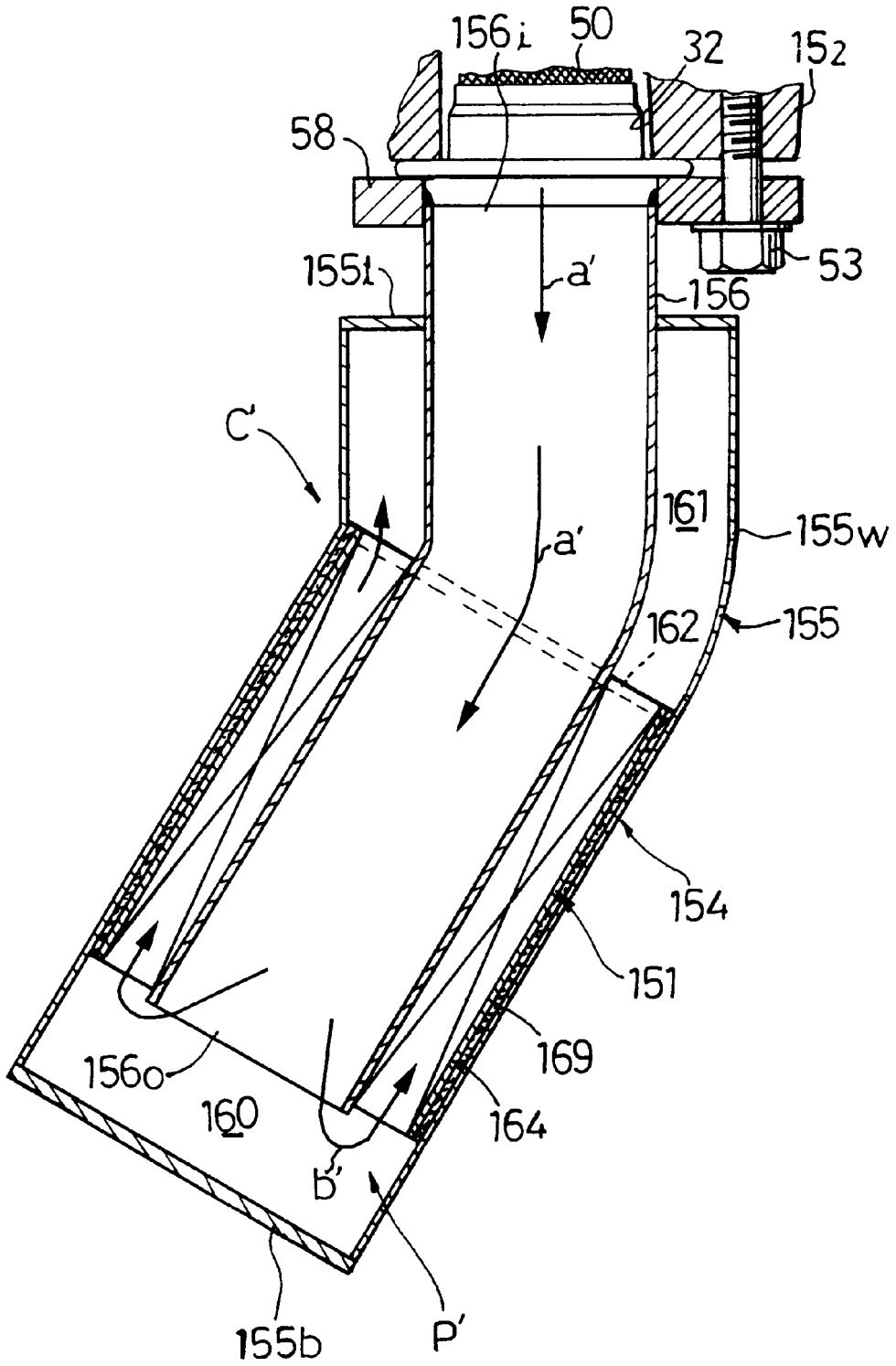
FIG. 12 is a vertical sectional view of the catalyst assembly taken along a line 12—12 in FIG. 10.
Figure 13:
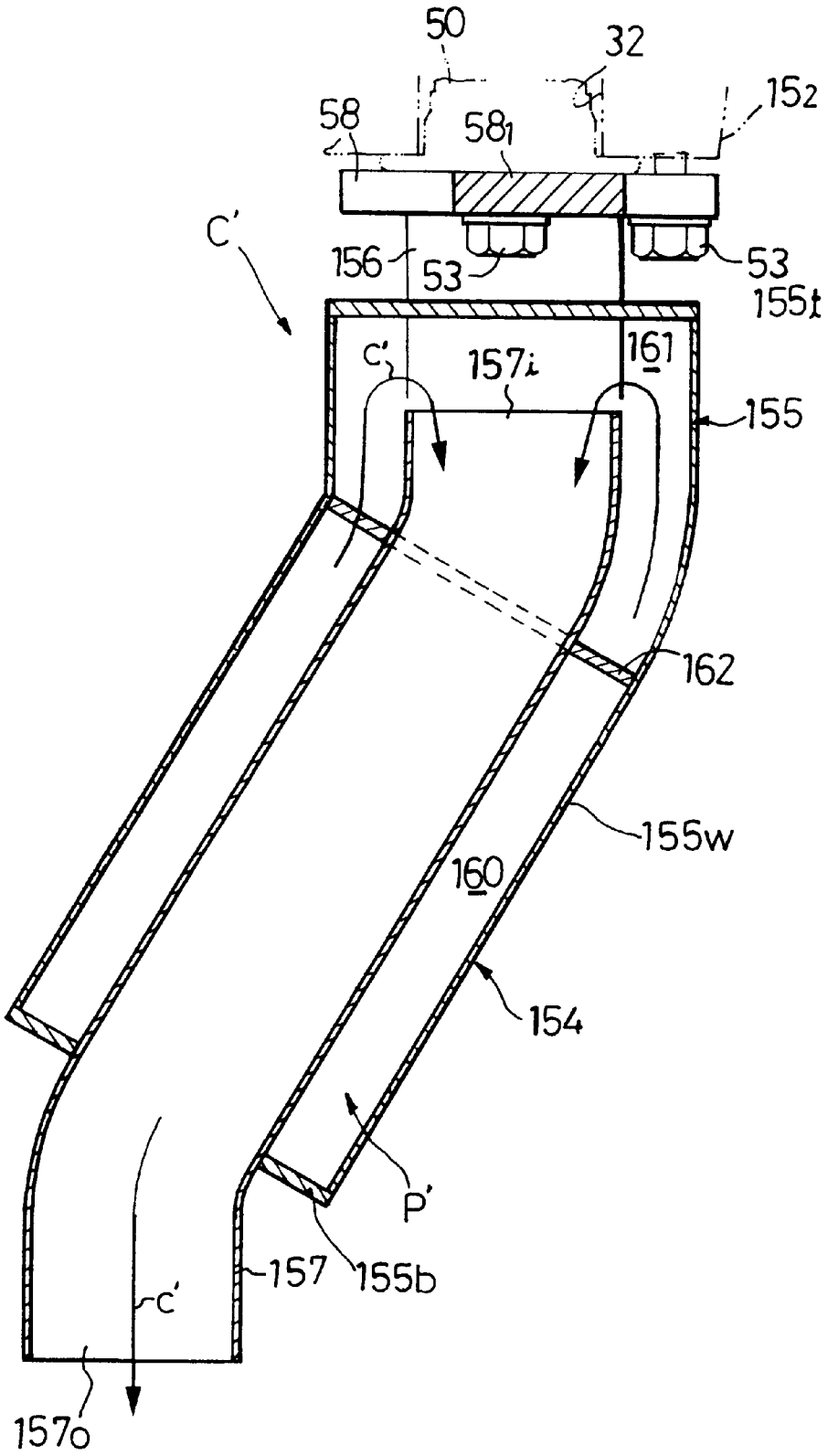
FIG. 13 is a vertical sectional view of the catalyst assembly taken along a line 13—13 in FIG. 10.
Figure 14:
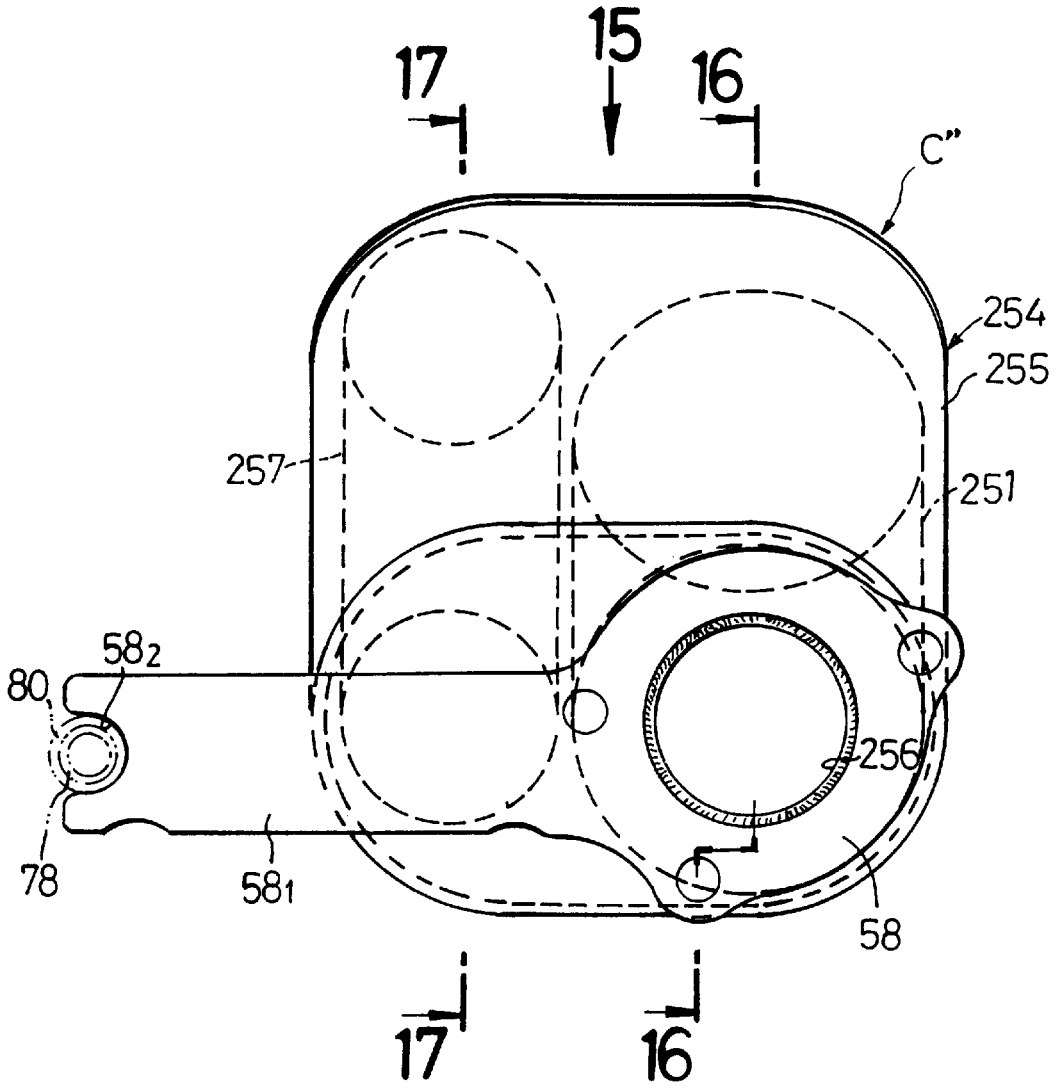
FIG. 14 is a plan view of a third embodiment of the catalyst assembly.
Figure 15:
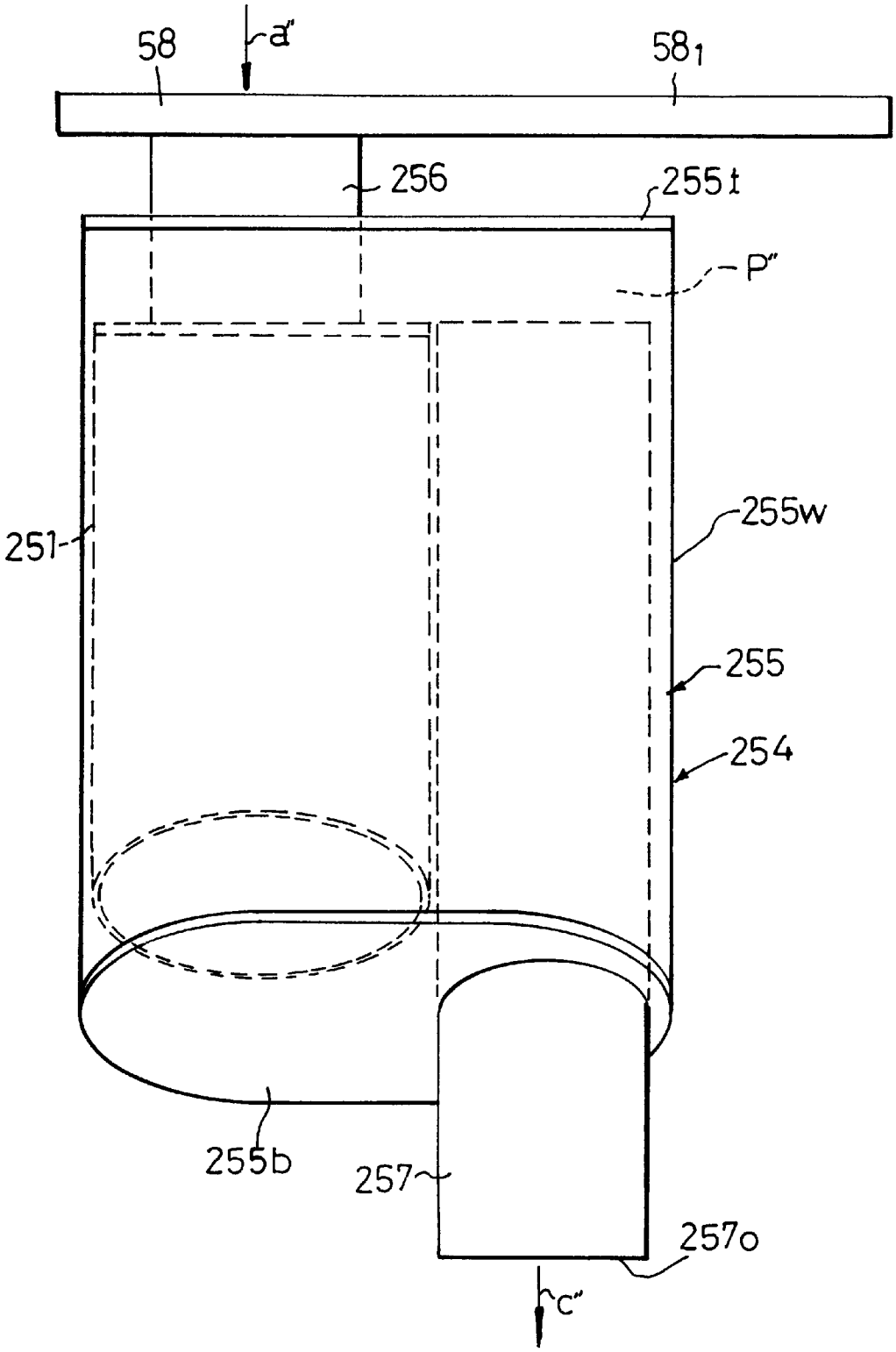
FIG. 15 is a side view of the catalyst assembly taken in a direction of an arrow 15 in FIG. 14.

In the second embodiment, a secondary catalyst 151 is wound around the outer peripheral surface of an exhaust gas introduction pipe 156. A catalyst assembly 154 comprises a catalyst case 155 which is formed with a top wall 155*t*, a bottom wall 55*b* and a side wall 155*w* which is substantially the same shape as in the first embodiment. The exhaust gas introduction pipe 156 and an exhaust gas discharging pipe 157 are inserted into the catalyst case 155. As shown in FIG. 12, the exhaust gas introduction pipe 156 has an inlet 156*i* coupled to a mounting flange 58, and extends along through a partition wall 162 which partitions the inside of the catalyst case 155 into a first chamber 160 and a second chamber 161. An outlet 160*o* at an inner end of the exhaust gas introduction pipe 156 opens into a bottom of the first chamber 160. The secondary catalyst 151 formed into a cylindrical shape is wound around the outer peripheral surface of the exhaust gas introduction pipe 156, and a heat-insulating material 169 is wound around an outer peripheral surface of the secondary catalyst 151. The outer half of the secondary catalyst 151 is bonded to an inner surface of the catalyst case 155 with the heat-insulating material 169 interposed therebetween. Further, the exhaust gas discharging pipe 157 is inserted into the catalyst case 155 through the bottom surface of the latter and extends vertically through the first chamber 160 and through the partition wall 162. The exhaust gas discharging pipe 157 has an inlet 157*i* which is provided at an upper end thereof and opens into the second chamber 161, and an outlet 157*o* which extends to the outside of the catalyst assembly 154. The inlet 157*a* at the upper end of the exhaust gas discharging pipe 157 is located above the secondary catalyst 151 as in the first embodiment.

The exhaust gas flowing into the catalyst assembly C' flows downwards from the exhaust gas introduction pipe 156 into the first chamber, as shown by an arrow a' in FIG. 12, where at reverses its course to flow upwards into the secondary catalyst 151, as shown by an arrow b' in FIG. 12. In the secondary catalyst 151, harmful components in the exhaust gas are reacted and removed, and then, the exhaust gas is passed into the second chamber 161, where it further reverses its course to flow downwards again into the exhaust gas discharging pipe 157, as shown by an arrow c' in FIG. 13 and then flows therefrom into the exhaust gas expansion chamber 34 in the extension housing 11. In the above manner, the exhaust gas flows within an exhaust gas purifying passage P' defined in the catalyst assembly C' while repeating the expansion and constriction as in the first embodiment. For this period of time, the exhaust gas noise is effectively attenuated and at the same time, the exhaust gas is effectively purified by the secondary catalyst 151 maintained at a proper temperature by the heat of the exhaust gas.

A third embodiment of the present invention will now be described with reference to FIGS. 14 to 17, wherein the same member or portions are designated by like reference numbers.

The third embodiment is slightly different from the first and second embodiments with respect of the structure of a catalyst assembly.

Figure 16:
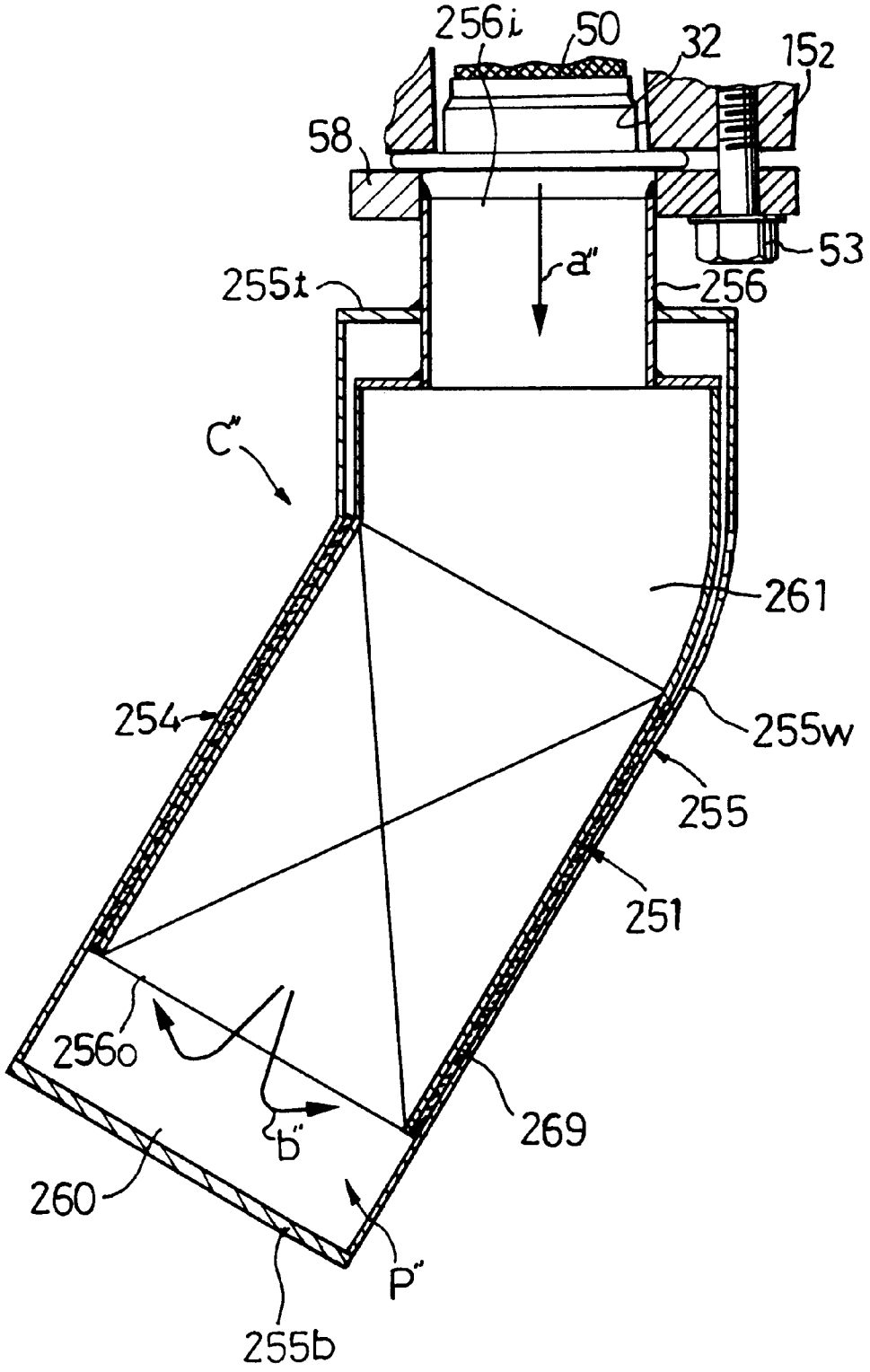
FIG. 16 is a vertical sectional view of the catalyst assembly taken along a line 16—16 in FIG. 14.
Figure 17:
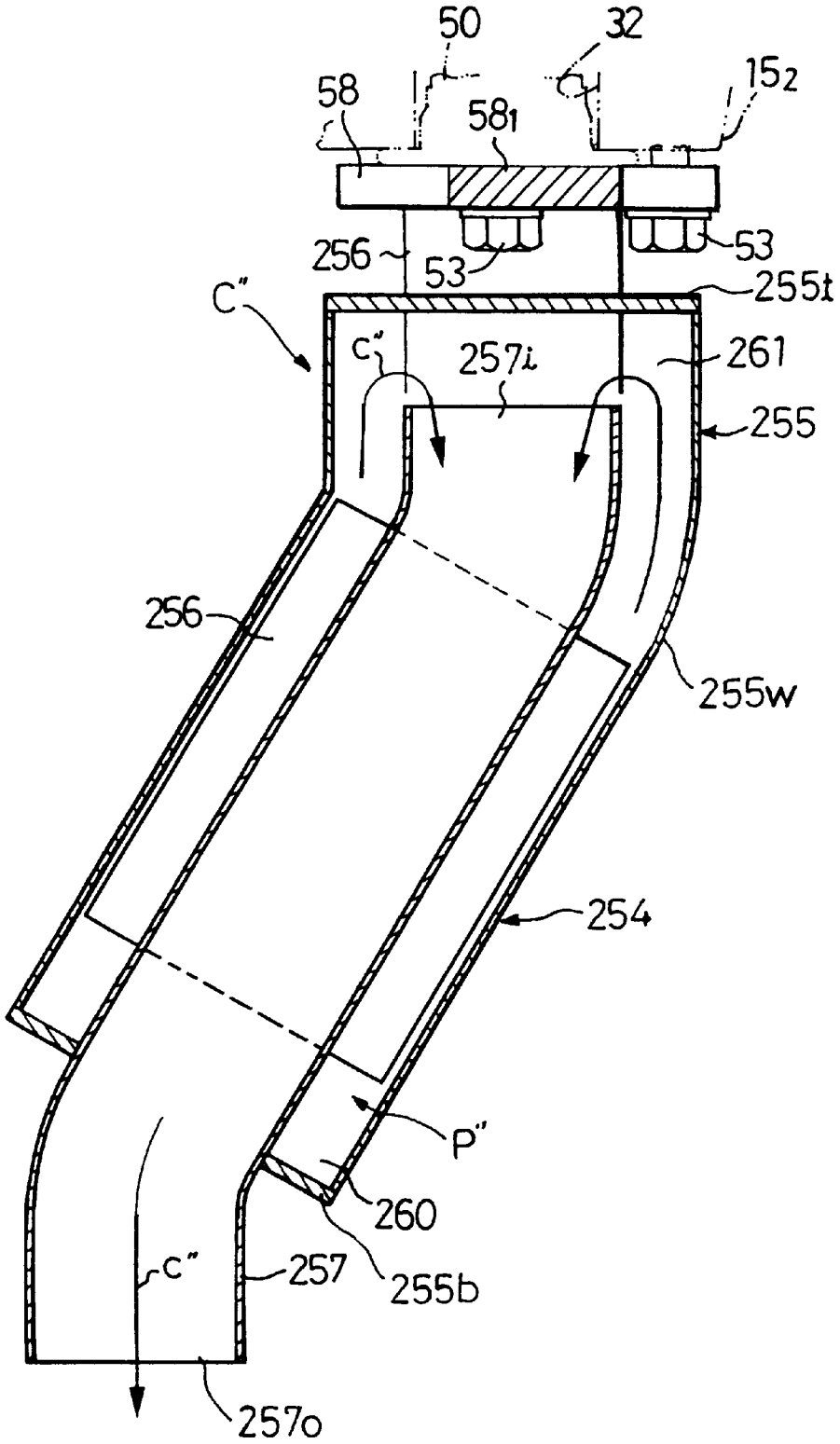
FIG. 17 is a vertical sectional view of the catalyst assembly taken along a line 17—17 in FIG. 14.

In the third embodiment, a secondary catalytic converter 251 is placed into exhaust gas introduction pipe 256. A catalyst assembly 254 comprises a catalyst case 255 which is formed of a top wall 255*t*, a bottom wall 255*b* and a side wall 255*w* which are substantially the same shape as in the first embodiment. The exhaust gas introduction pipe 256 and an exhaust gas discharging pipe 257 are inserted into the catalyst case 255. As shown in FIG. 16, the exhaust gas introduction pipe 256 is formed with a diameter larger than those in the first and second embodiments, and has an inlet 256*i* fastened to the mounting flange 58 and is inserted into one side of the catalyst case 255 through the top wall 255*t*. Outlet 256*o* which opens into the bottom of the catalyst case 255. The secondary solid cylindrical catalyst 251 is placed into the exhaust gas introduction pipe 256, and the inside of the catalyst case 255 is partitioned into a first chamber 260 and a second chamber 261 by the secondary catalyst 251. A heat-insulating material 269 is wound around an outer peripheral surface of the exhaust gas introduction pipe 256 in correspondence with the secondary catalyst 251 and is bonded to an inner surface of the catalyst case 255. As shown in FIG. 17, the exhaust gas discharging pipe 257 is inserted into the other side of the catalyst case 255 through the bottom wall 255*b* in line with the exhaust gas introduction pipe 256. The exhaust gas discharging pipe 257 has an inner end, i.e., an inlet 257*i* which opens into an upper portion of the catalyst case 255, and an outlet 257*o* which is provided at its lower end and extends to the outside of the catalyst assembly 254. The inlet 157*i* at the upper end of the exhaust gas discharging pipe 257 is located above the secondary catalyst 51 as in the first embodiment.

An exhaust gas flowing into the catalyst assembly C" flows downwards within the exhaust gas introduction pipe 256 to enter the secondary catalyst 25, as shown by an arrow a" in FIG. 16, where harmful components in the exhaust gas are reacted and removed. Then, the exhaust gas flows into the second chamber 261, where it reverses its course to flow upwards, as shown by an arrow b" an FIG. 16, and reverses its course again to flow downwards within the exhaust gas discharging pipe 257, as shown by an arrow c" in FIG. 17 and then into the exhaust gas expansion chamber 34 within the extension housing 11. In the above manner, the exhaust gas flows within an exhaust gas purifying passage P" defined in the catalyst assembly C" while repeating the expansion and constriction, as in the first embodiment. For this period of time, the exhaust gas noise is effectively attenuated and at the same time, the exhaust gas is effectively purified by the secondary catalyst 251 maintained at a proper temperature by the heat of the exhaust gas.

Although the first, second and third embodiments of the present invention have been described, it will be understood that the present invention is not limited to these embodiments and various modifications may be made within the scope of the invention defined in claims. For example, although the present invention is applied to the 4-cylinder and 4-cycle engine in the above-described embodiments, it can be of course applied to other 4-cycle engines. On addition, the primary and secondary catalysts may be of any structure and any type. Further, although the present invention has been described as employing the primary and secondary catalysts in the above-described embodiments, the primary catalyst may be omitted. On this case, a ternary catalyst capable of oxidizing and reducing harmful components in the exhaust gas to remove them is employed.

As discussed above, in the outboard engine system equipped with the 4-cycle engine, the catalyst assembly having the catalyst therein is contained in the exhaust gas expansion chamber in the extension housing. Therefore, it is possible to minimize the increase in size of the outboard engine system, particularly, its heat portion, and further, the temperature of the intake air does not rise due to a rise in temperature of a large amount of oil, as compared with the known exhaust emission control systems in which an oil pan is provided within an engine compartment, thereby bringing about no reduction in engine heat output. In addition, the catalyst case is formed flat in cross section, with the lengthwise direction of the cross section being in the lengthwise direction of the cross section of the oil pan, and the catalyst case is disposed in line with the oil pan, with at least a portion thereof being contained in a recess defined in the oil pan. Therefore, the following special affect is provided: notwithstanding that the oil pan and the catalyst assembly are contained within the extension housing, the extension housing is not increased in size.

Further, the oil pan and the catalyst assembly are disposed in line on the opposite side from the drain portion of the oil pan. Therefore, in addition to the above effect, the oil pan and the catalyst assembly can be disposed in line in proximity to each other without interference with each other, thereby inhibiting an increase in size of the extension housing.

Still further, the catalyst is contained within the catalyst case of the catalyst assembly and therefore, in addition to the above effect, the catalyst can be maintained at the proper temperature to enhance the purifying efficiency thereof and further, the catalyst can be protected, leading to a prolonged life thereof.

Further, the inlet of the exhaust gas discharging pipe of the catalyst assembly is located above the catalyst. Thus, in addition to the above effect, notwithstanding that the catalyst is mounted within the extension housing, the immersion of the catalyst in water can be reduced even if the outboard engine system is in any cruising state.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. An engine exhaust emission control system for a 4-cycle outboard engine, said engine including a mounting member; an engine block mounted on said mounting member, an extension housing coupled to said mounting member and extending downward therefrom, an engine oil pan mounted under said mounting member within said extension housing, and an exhaust gas expansion chamber formed in said extension housing for receiving exhaust gas from said engine block, and said engine exhaust emission control system comprising:

an exhaust gas purifying passage and a catalyst assembly positioned in said exhaust gas expansion chamber, said exhaust gas purifying passage extending down from an upper portion in said extension housing at one lateral side thereof in front and rear directions of the engine, toward a laterally center portion of the extension housing while inclining laterally inwardly.

2. An engine exhaust emission control system according to claim 1, wherein said oil pan has a recess formed in a lengthwise direction thereof, and said catalyst assembly has a catalyst case which is aligned with said oil pan in the lengthwise direction thereof, wherein at least a portion of said catalyst case is disposed in the recess in said oil pan.

3. An engine exhaust emission control system for a 4-cycle outboard engine, said engine including a mounting member, an engine block mounted on said mounting member, an extension housing coupled to said mounting member and extending downward therefrom, an engine oil pan mounted under said mounting member within said extension housing, said oil pan having a recess formed therein in the lengthwise direction, and an exhaust gas expansion chamber formed in said extension housing for receiving exhaust gas from said engine block, said engine exhaust emission control system comprising:

a catalyst assembly positioned in said exhaust gas expansion chamber, said catalyst assembly having a catalyst case aligned with said oil pan in the lengthwise direction thereof, wherein at least a portion of said catalyst case is disposed in said recess in said oil pan, and wherein said catalyst assembly comprises an exhaust gas introduction pipe, extending from said engine into said catalyst case;

an exhaust gas discharge pipe extending from said catalyst case into said exhaust gas expansion chamber, said introduction pipe and said discharge pipe being axially oriented in the lengthwise direction of said catalyst case; and an exhaust gas purifying passage within said catalyst case and having a catalyst therein; wherein said introduction pipe and said discharge pipe form at least a portion of said exhaust gas purifying passage.

4. An engine exhaust emission control system as recited in claim 3, wherein said exhaust gas discharge pipe is located forwardly of said exhaust gas introduction passage in the front and rear directions of the engine.

5. An engine exhaust emission control system as recited in claim 3, wherein said catalyst is formed of a cylindrical shape and secured to an outer periphery of a said exhaust gas discharge pipe.

6. An engine exhaust emission control system as recited in claim 3, wherein said catalyst is formed of a cylindrical shape and secured to an outer periphery of said exhaust gas introduction pipe.

7. An engine exhaust emission control system as recited in claim 3, wherein said catalyst is formed of a solid cylindrical shape and secured to an end of said exhaust gas introduction pipe that is projected into said catalyst case.

8. An engine exhaust emission control system for a 4-cycle outboard engine, said engine including a mounting member, an engine block mounted on said mounting member, an extension housing coupled to said mounting member and extending downward therefrom, an engine oil pan mounted under said mounting member within said extension housing, said oil pan having a recess formed therein in the lengthwise direction, and an exhaust gas expansion chamber formed in said extension housing for receiving exhaust gas from said engine block, said engine exhaust emission control system comprising:

a catalyst assembly positioned in said exhaust gas expansion chamber, said catalyst assembly having a catalyst case aligned with said oil pan in the lengthwise direction thereof, wherein at least a portion of said catalyst case is disposed in said recess in said oil pan, and wherein catalyst assembly comprises a partition wall for partitioning said catalyst case into a first chamber and a second chamber;

an exhaust gas introduction pipe extending from said engine into said first chamber of said catalyst case through a top wall thereof for carrying exhaust from said engine to said first chamber;

an exhaust gas discharge pipe, extending from said second chamber of said catalyst case to said exhaust gas expansion chamber; and an exhaust gas purifying passage, having a catalyst therein, said exhaust gas introduction pipe and discharge pipe extending into at least a portion of said purifying passage; wherein the inset of said exhaust gas discharge pipe is located higher than said catalyst in said catalyst case.

9. An engine exhaust emission control system as recited in claim 8, wherein said catalyst is formed of a cylindrical shape and secured to an outer periphery of said exhaust gas discharge pipe.

10. An engine exhaust emission control system as recited in claim 8, wherein said catalyst is formed of a cylindrical shape and secured to an outer periphery of said exhaust gas introduction pipe.

11. An engine exhaust emission control system as recited in claim 8, wherein said catalyst is formed of a solid cylindrical shape and secured to an end of said exhaust gas introduction pipe that is projected into said catalyst case.

* * * * *